US007495396B2

(12) United States Patent
Németh et al.

(10) Patent No.: US 7,495,396 B2
(45) Date of Patent: Feb. 24, 2009

(54) DIELECTRIC BARRIER DISCHARGE LAMP

(75) Inventors: Zsolt Németh, Budapest (HU); Csenge Csoma, Budapest (HU); Lajos Reich, Budapest (HU); László Bánkuti, Budapest (HU)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/304,105

(22) Filed: Dec. 14, 2005

(65) Prior Publication Data

US 2007/0132384 A1 Jun. 14, 2007

(51) Int. Cl.
*H01J 29/87* (2006.01)

(52) U.S. Cl. ..... 313/631; 313/607; 313/234

(58) Field of Classification Search ..... 313/581, 313/567, 574, 613, 622, 631, 607, 234, 36
See application file for complete search history.

(56) References Cited

U.S. PATENT DOCUMENTS 5,581,152 A * 12/1996 Matsuno et al. ..... 313/634
5,604,410 A 2/1997 Vollkommer et al.
5,714,835 A 2/1998 Zachau et al.
5,763,999 A 6/1998 Matsuno et al.
5,994,849 A 11/1999 Volkommer et al.
6,049,086 A 4/2000 Foggiato et al.
6,060,828 A 5/2000 Vollkommer et al.
6,407,513 B1 * 6/2002 Vollkommer et al. ..... 315/246
6,525,451 B1 * 2/2003 Hishinuma et al. ..... 313/234
6,605,899 B2 * 8/2003 Berlinghof et al. ..... 315/58
6,633,109 B2 10/2003 Falkenstein
6,777,878 B2 8/2004 Berlinghof et al.
6,888,041 B1 * 5/2005 Nakamura ..... 313/238
7,276,851 B2 * 10/2007 Tanabe et al. ..... 313/607
2002/0067130 A1 6/2002 Falkenstein
2004/0130256 A1 * 7/2004 Juestel et al. ..... 313/487
2005/0156497 A1 * 7/2005 Nakamura ..... 313/238
2005/0236997 A1 * 10/2005 Danner et al. ..... 313/634
2005/0253522 A1 * 11/2005 Tokes et al. ..... 313/634
2006/0006805 A1 1/2006 Reich et al.

FOREIGN PATENT DOCUMENTS

WO WO 03/090252 * 10/2003
WO WO 2006006129 A2 * 1/2006

* cited by examiner

*Primary Examiner*—Nimeshkumar D. Patel
*Assistant Examiner*—Anne M Hines
(74) *Attorney, Agent, or Firm*—Fay Sharpe LLP

(57) ABSTRACT

A dielectric barrier discharge lamp is disclosed, which comprises a discharge vessel having a principal axis. The discharge vessel encloses a discharge volume filled with a discharge gas. The discharge vessel further comprises end portions intersected by the principal axis. At least one electrode of a first type and at least one electrode of a second type are used in the lamp. The electrodes of one type are energized to act as a cathode and the electrodes of other type are energized to act as an anode. The electrodes are substantially straight, elongated electrodes with a longitudinal axis substantially parallel to the principal axis of the discharge vessel. At least one of the electrodes is positioned within the discharge volume, and the electrodes of at least one type are isolated from the discharge volume by a dielectric layer. At least one of the electrodes inside the discharge volume is provided with an outer luminescent layer. Additionally, at least one of the electrodes inside the discharge volume provided with a luminescent layer may have a reflective layer under the luminescent layer.

2 Claims, 6 Drawing Sheets

DIELECTRIC BARRIER DISCHARGE LAMP

BACKGROUND OF THE INVENTION

This invention relates to a dielectric barrier discharge lamp.

The majority of the known and commercially available low-pressure discharge lamps are so-called compact fluorescent lamps. These lamps have a gas fill which also contains small amount of mercury. Since mercury is a highly poisonous substance, novel types of lamps are being recently developed. One promising candidate to replace mercury-filled fluorescent lamps is the so-called dielectric barrier discharge lamp (shortly DBD lamp). Besides eliminating the mercury, it also offers the advantages of long lifetime and negligible warm-up time.

As explained in detail, for example, in U.S. Pat. No. 6,633,109 the operating principle of DBD lamps is based on a gas discharge in a noble gas (typically Xenon). The discharge is maintained through a pair of electrodes, between which there is at least one dielectric layer. An AC voltage of a few kV with a frequency in the kHz range is applied to the electrode pair. Often, multiple electrodes with a first polarity are associated to a single electrode having the opposite polarity. During the discharge, excimers (excited molecules) are generated in the gas, and electromagnetic UV and VUV radiation is emitted when the meta-stable excimers dissolve. The electromagnetic radiation of the excimers is converted into visible light by suitable luminescent material, in a physical process similar to that occurring in mercury-filled fluorescent lamps. This type of discharge is also referred to as dielectrically impeded discharge.

As mentioned above, DBD lamps must have at least one electrode set which is separated from the discharge gas by a dielectric. It is known to employ the wall of the discharge vessel itself as the dielectric. In this manner, a thin film dielectric layer may be avoided. This is advantageous because a thin film dielectric layer is complicated to manufacture and it is prone to deterioration. Various discharge vessel-electrode configurations have been proposed to satisfy this requirement. U.S. Pat. No. 5,994,849 discloses a planar configuration, where the wall of the discharge vessel acts as a dielectric. The electrodes with opposite polarities are positioned alternating to each other. The arrangement has the advantage that electrodes do not cover the discharge volume from at least one side, but a large proportion of the energy used to establish the electric field between the electrodes is dissipated outside the discharge vessel. On the other hand, a planar lamp configuration cannot be used in the majority of existing lamp sockets and lamp housings, which were designed for traditional incandescent bulbs.

U.S. Pat. Nos. 6,060,828 and 5,714,835 disclose substantially cylindrical DBD light sources, which are suitable for traditional screw-in sockets. These lamps have a single internal electrode within a discharge volume, which is surrounded on the external surface of a discharge vessel by several external electrodes. It has been found that such an electrode configuration does not provide a sufficiently homogenous light, because the discharge within the relatively large discharge volume tends to be uneven. Certain volume portions are practically completely devoid of an effective discharge, particularly those volume portions, which are further away from both electrodes.

U.S. Pat. No. 6,777,878 discloses DBD lamp configurations with elongated electrodes that are arranged on the inside of the wall of a cylindrical discharge vessel and are covered by a dielectric layer. In this configuration the electrodes are in a relatively large distance from each other, therefore a very high voltage is required to start ignition. In order to overcome cold starting difficulties an external metal ring is suggested at one end of the elongated cylindrical discharge vessel. This lamp configuration belongs to the group of DBD lamps of traditional elongated cylindrical shape and cannot be used as a replacement of an incandescent lamp.

Although DBD lamps are more environmentally friendly because of eliminating the need for mercury and also offer the advantage of long lifetime and negligible warm-up time, they still have one drawback, a relatively low efficiency. Several attempts have been made in order to overcome this disadvantage. U.S. Pat. No. 5,604,410 for example proposes generating a specific train of voltage pulses of a predetermined pulse form pulse time and idle time in order to increase the efficiency of BDB lamps. The improvement in efficiency achieved by this method of operation is however limited.

Another attempt is made by an invention disclosed in US continuation in part application of Ser. No. 11/112,320 filed by the present applicant on Apr. 22, 2005, in which electrodes with a dielectric layer acting as a cathode and an anode inside the discharge volume are used. By appropriate selection of the number and the geometry of arrangement of the electrodes, a substantial improvement of the output luminous efficiency can be accomplished. In these lamps, the inside surface of the discharge vessel may be covered with a luminescent layer containing phosphor. In such an arrangement, the surface area covered with the luminescent layer limits the output luminosity. As this surface area is determined by the lamp geometry, the output luminosity of such a lamp cannot be increased to an extent, as it would be desirable.

Accordingly, there is a need for a DBD lamp configuration with an improved efficiency and luminous output. It is sought to provide a DBD lamp, which, while having an improved discharge vessel-electrode arrangement, is relatively simple to manufacture. Further, it is sought to provide a discharge vessel-electrode configuration, which readily supports different types of electrode set configurations, according to the characteristics of the used discharge gas, exciting voltage, frequency and exciting signal shape. The proposed DBD lamp can be used as a replacement of the traditional incandescent lamps and fluorescent lamps containing mercury. It has an electrode arrangement, which minimizes the self-shadowing effect of the electrodes in order to provide for a higher luminance and efficiency.

SUMMARY OF THE INVENTION

In an exemplary embodiment of the invention, there is provided a dielectric barrier discharge lamp comprising a discharge vessel having a principal axis, the discharge vessel enclosing a discharge volume filled with a discharge gas. The discharge vessel further comprises end portions intersected by the principal axis. At least one electrode of a first type and at least one electrode of a second type are used in the lamp. The electrodes of one type are energized to act as a cathode and the electrodes of the other type are energized to act as an anode. The electrodes are substantially straight, elongated electrodes with a longitudinal axis substantially parallel to the principal axis of the discharge vessel. At least one of the electrodes is positioned within the discharge volume. The electrodes of at least one type are isolated by a dielectric layer. At least one of the electrodes inside the discharge volume is provided with an outer luminescent layer.

In an exemplary embodiment of another aspect of the invention, at least one of the electrodes positioned inside the discharge volume and provided with a luminescent layer has a reflective layer under the luminescent layer additionally.

The disclosed DBD lamp has several advantages over the prior art. It enables that the available discharge volume is fully used to receive the electrodes of both type (cathodes and anodes) and no other elements are located within the discharge vessel that would decrease the available discharge volume and cause certain shadowing effect. The arrangement of all electrodes inside the discharge vessel and parallel to each other will enable the use of an AC power supply delivering exiting voltages of 1-5 kV with a frequency in the kHz range because of the shorter distance between the electrodes. The density of the lines of force of the electric field is substantially higher than in known conventional lamp configurations with external electrodes. The lamp according to the invention will operate with an increased efficiency due to the luminescent layer on the electrodes. The use of an additional reflecting layer under the luminescent layer will further increase this effect. The increased efficiency is due to the fact that VUV photons originating from the discharge, that otherwise would have been absorbed by the electrodes, now will be converted into visible white or colored light, which is totally or partially mirrored towards outside of the lamp. In addition to this, the lamp can provide a uniform and homogenous volume discharge, and a large illuminating surface.

BRIEF DESCRIPTION OF DRAWINGS

Further aspects and advantages of the invention will be described with reference to enclosed drawings, where.

DETAILED DESCRIPTION OF THE INVENTION

Figure 1:
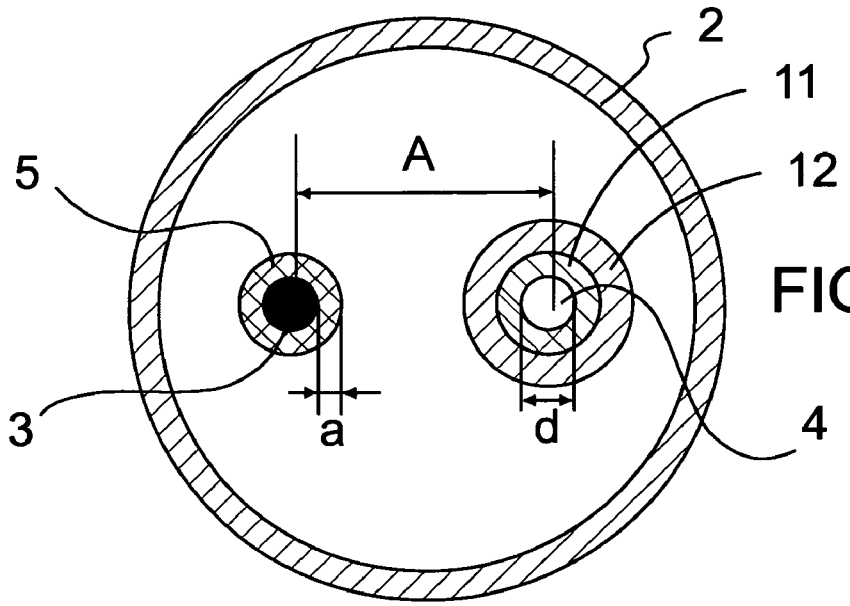
FIG. 1 is a top view in cross section of a dielectric barrier discharge lamp with a cylindrical discharge vessel enclosing two electrodes of different type.
Figure 2:
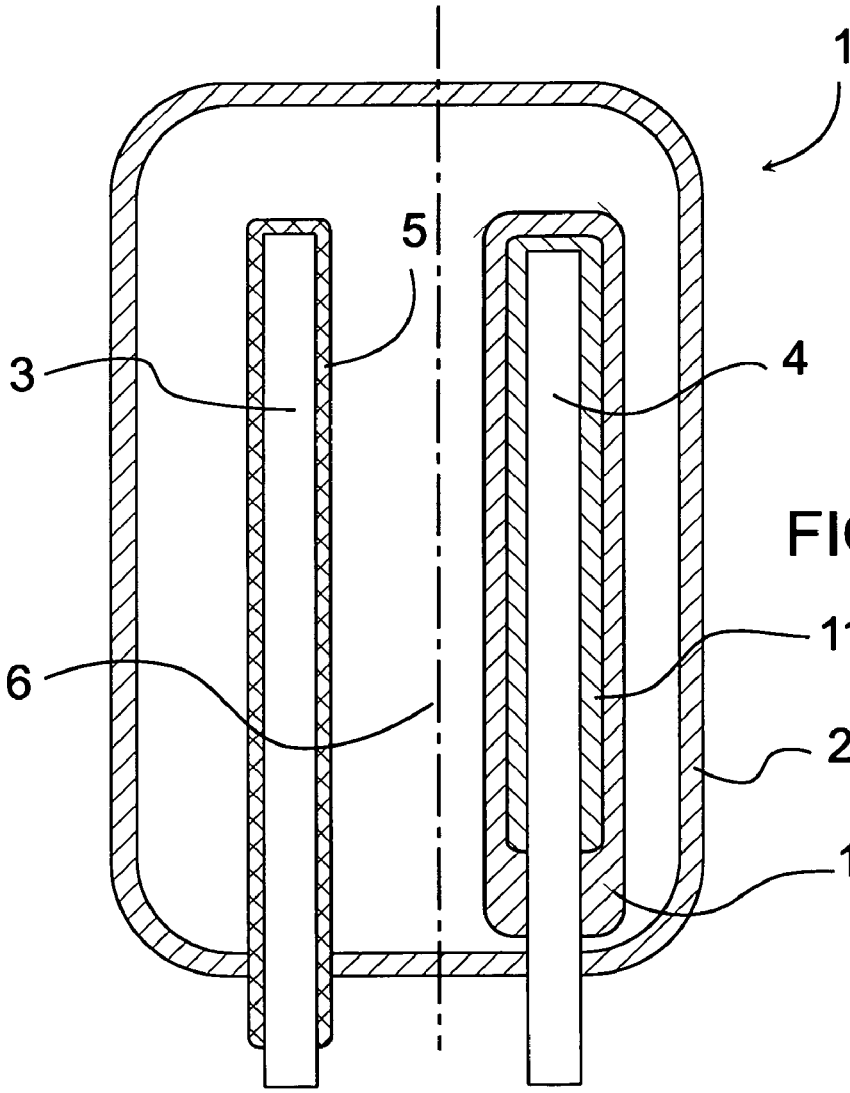
FIG. 2 is a side view in cross section of a dielectric barrier discharge lamp with a cylindrical discharge vessel shown in FIG. 1.

Referring now to FIGS. 1 and 2, there is shown schematic picture of a low-pressure discharge lamp 1. The lamp is a dielectric barrier discharge lamp (hereinafter also referred to as DBD lamp), with a single discharge vessel 2 serving also as an envelope of the DBD lamp. The discharge vessel 2 encloses a discharge volume, which is filled with discharge gas. The wall of the discharge vessel may be coated with a luminescent layer in order to convert short wave radiation of the excited gas into visible light. In the shown embodiment, the discharge vessel is substantially cylindrical and its wall forming an envelope is made of a transparent or translucent material, which may be a soft or hard glass, or any type of quartz material or any suitable ceramic material, which is transparent or at least translucent to the wavelength emitted by the lamp. A luminescent layer may cover the wall of the discharge vessel. For reason of higher security, also a separate external envelope (not shown) may be used which may be made of the same material as the discharge vessel or a suitable plastic material which is transparent or at least translucent to the wavelength emitted by the lamp. The discharge vessel 2 and the external envelope (if used) are mechanically supported by a lamp base (not shown), which also holds the contact terminals of the lamp 1, corresponding to a standard plug-in, screw-in or bayonet socket. The lamp base may also house an AC power source of a known type, which delivers an AC voltage of 1-5 kV with 50-200 kHz frequency, and need not be explained in more detail. The operation principles of power sources for DBD lamps are disclosed, for example, in U.S. Pat. No. 5,604,410.

Inside the discharge vessel 2, there are two electrodes 3 and 4 of different type arranged substantially parallel to each other and a principal axis 6 of the discharge vessel 2. The electrodes are energized by an AC power supply (not shown) in order to act as an anode and a cathode. Both of the electrodes are guided through the same end region of the discharge vessel, which provides for a more convenient connection of the electrodes to the AC power supply. One of the electrodes is isolated from the discharge volume by a dielectric layer 5. Due to the working principle of the DBD lamps, there must be a dielectric isolating layer between the electrodes of different type, which prevents the forming of a continuous arc and the flow of electric current. For this purpose, it is enough to isolate one of the two electrodes by a dielectric layer as shown in FIGS. 1 and 2. As a dielectric layer, any material with sufficiently high dielectric constant that can be bound to the electrode may be used. In order to provide for a homogenous discharge along the electrode, the dielectric layer should have the same thickness a along the electrode inside the discharge vessel. The thickness of the dielectric layer should be kept as low as possible and may be approximately 0.25 mm. If the material used as a dielectric layer and the material of the discharge vessel are the same, it will be easier to provide hermetic seal in the feed-through region of the discharge vessel. The other of the two electrodes, which is not provided with an isolating dielectric layer, is covered with an outer luminescent layer 12 for providing visible light when excited by VUV radiation from the discharge. In order to avoid the absorbing effect of the electrode, a reflective layer 11 is used under the luminescent layer 12, which reflects visible light. It is advantageous to keep the surface area of the luminescent layer 12 as large as possible, e.g. to cover substantially the whole of the surface of the electrode inside the envelope. In order to increase efficiency of the lamp, at least a part of the electrode may be covered by a reflective layer 11 under the luminescent layer 12. In order to achieve a maximum efficiency of the lamp, the reflective layer should cover substantially the whole of the surface of the electrode under the luminescent layer 12. The reflective layer hinders the absorption of the visible light that is generated in the luminescent layer by reflecting it back from the electrode and hence increases the efficiency of the lamp. The material of the luminescent layer may be selected from a group of phosphor compounds in order to provide a visible light with a green, red and blue color component. The percentage of the color components will determine the visible appearance of the lamp. The component producing green color may comprise at least one compound selected from the group consisting of Cerium and Terbium doped Lanthanum Phosphate ($LaPO_4$:Ce,Tb); Terbium doped Cerium Magnesium Aluminate ($CeMgAl_{11}O_{19}$:Tb); and Manganese doped Zinc Silicate ($Zn_2SiO_4$:Mn). The component producing red color may comprise at least one compound selected from the group consisting of Europium doped Yttrium Oxide ($Y_2O_3$:Eu) and Europium doped Yttrium Vanadate Phosphate Borate ($Y(V,P,B)O_4$:Eu. For providing a component producing blue color, at least one compound selected from the group consisting of Europium doped Barium, Magnesium Aluminate ($BaMgAl_{10}O_{17}$:Eu) and Europium doped Strontium Aluminate ($Sr_4Al_{14}O_{25}$:Eu) may be used in the luminescent layer. If the luminescent layer is thick enough, then practically all of the VUV photons emanating from the discharge are converted into visible light. The thickness of the luminescent layer applied to the electrode should be selected in the range of a usual phosphor layer on the wall of the discharge vessel or even larger. This means that the thickness should be at least 2 mg/cm$^2$, but preferably in the range of 3-6 mg/cm$^2$ if phosphors with a particle size typically in the range of 1-8 micrometer are used. In lamps for home lighting purposes, a tri-phosphor mixture can be used, in which the ratio of blue, red and green components must be adjusted in a way that the coating gives a white light, i.e. the color is in the vicinity of the black body curve and with the desired color temperature. Similarly to the phosphor layer on the wall of the discharge vessel, the composition of the phosphor layer on the electrodes should be designed in a way that all phosphors that are used must efficiently absorb and be excited by the Xe excimer discharge (wavelengths of 140-180 nm).

When using different phosphor compounds, different visual effect can be accomplished. In order to provide an UV lamp, it would be necessary to use a phosphor compound, which is capable of converting VUV radiation into UV radiation.

The reflective layer 11 may be of aluminum oxide $Al_2O_3$ or any other material that efficiently reflects visible light. The particle size and thickness of this layer is selected in a manner so that the desired strength and reflecting capability are accomplished. In order to provide for a diffuse reflection of incident light, the mirroring surface should be coarse, which may be achieved by using alumina with particle size in the nm to μm range. This kind of alumina layer can also serve as a protection of the cathodes itself. When the discharge is in filamentary mode, the cathode can locally be overheated that leads to local melting of the electrode and finally to a lamp defect. This effect can be reduced by a thick protective layer. The reflective layer has to be designed in a way that it cannot be washed down when the next layer, i.e. the phosphor layer is coated on. In case of aqueous suspension formulations, using additives, e.g. ammonium salt of copolymer of metacrylic acid and acrylic ester can substantially prevent the reflective layer from washing down. Instead of alumina, other reflecting coatings such as MgO may also be used as a reflecting layer, which has a further advantage of increasing the adhesion of the phosphor coating.

The electrodes in the proposed embodiment are straight elongated rod-like wires made of a good conductor material, such as silver or copper. The diameter d of the electrodes is preferably approximately 1 mm. Tubular electrodes may also be used in order to reduce the weight of and material used for manufacturing the electrodes. The distance A of the parallel electrodes 3 and 4 is not critical but with increasing distance the magnitude of the exciting voltage also increases. For exciting voltages of 2-5 kV an electrode distance A of 2 and 5 mm has been found suitable. In order not to exceed the 3 kV limit of the exciting voltage, the distance A of the neighboring electrodes 3 and 4 of different type should not exceed 3 mm. This electrode distance is also termed as the discharge gap, and its value also influences the general parameters of the discharge process within the discharge vessel 2.

Figure 3:
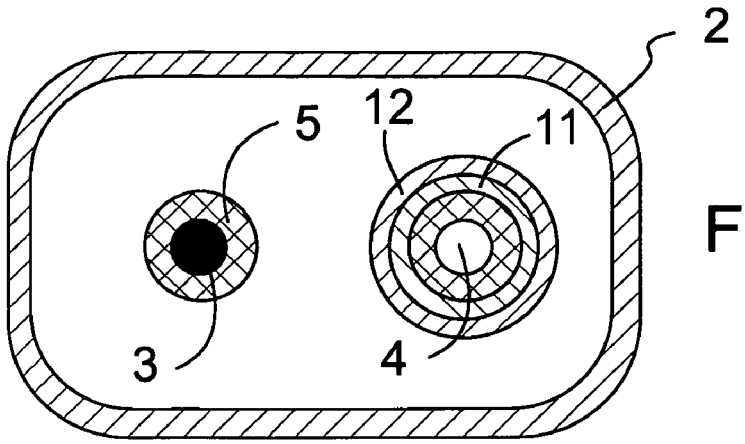
FIG. 3 is a top view in cross section of a dielectric barrier discharge lamp with a flat discharge vessel and an electrode arrangement different from that shown in FIG. 1.
Figure 4:
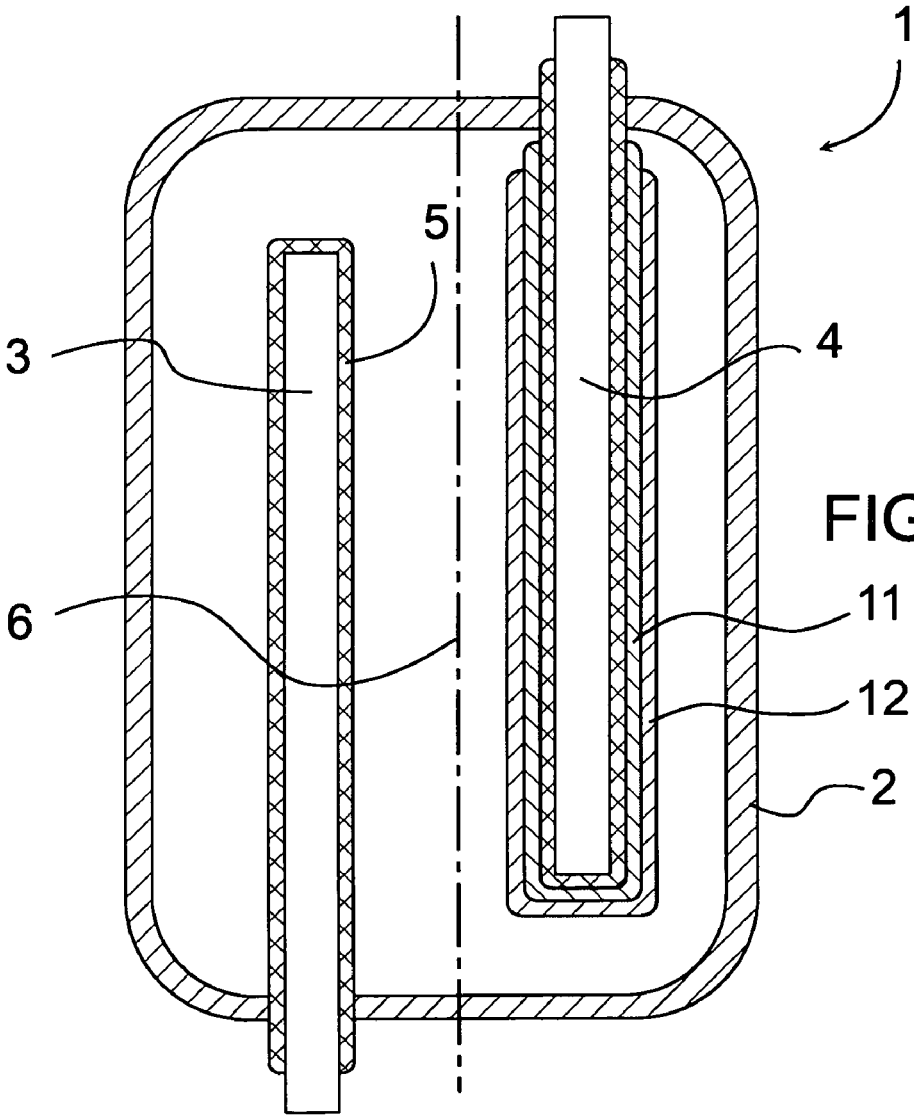
FIG. 4 is a side view in cross section of a dielectric barrier discharge lamp shown in FIG. 3.

FIGS. 3 and 4 show a DBD lamp with a different discharge vessel electrode configuration. Inside the discharge vessel 2, there are two electrodes 3 and 4 of different type arranged parallel to each other and the principal axis 6 of the discharge vessel 2. The electrodes are energized by an AC power supply (not shown) in order to act as an anode and a cathode. The electrodes are guided through the opposite end portions of the discharge vessel which provides for a more convenient fixing of the electrodes to the discharge vessel at the feed-through regions of the end portions. Dissimilar to FIGS. 1 and 2, in the embodiment shown in FIGS. 3 and 4, both of the electrodes are isolated from the discharge volume by a dielectric layer 5. Another difference to the first embodiment is that the discharge vessel has a substantially rectangular cross section with slightly rounded corner regions. This discharge vessel arrangement may be useful to provide a more homogenous distribution of the electric field providing also for a more homogenous excitation of the gas within a discharge vessel 2. It has been found that by increasing the number of electrodes, the homogeneity of the electric field and therefore the homogeneity of the discharge distribution may be improved. Again only one of the electrodes is covered with a luminescent layer 12 and a reflective layer 11 under the luminescent layer as discussed in detail in connection with FIGS. 1 and 2. In this embodiment, this electrode has a dielectric layer, which covers the whole of the electrode surface inside the discharge volume and a part of the electrode surface outside the discharge vessel. The reflecting layer 11 is used on the dielectric layer and covers substantially the whole of the electrode surface inside the discharge vessel. The luminescent layer 12 is used on the reflecting layer 11 and covers substantially the whole of the electrode surface inside the discharge vessel. In the shown embodiment, the electrode surface covered by the reflecting layer 11 is larger than the electrode surface covered by the luminescent layer 12, however these covered surface areas may also be equal as shown in FIG. 4. The following embodiments show different electrode arrangements with at least one electrode of a type.

Figure 5:
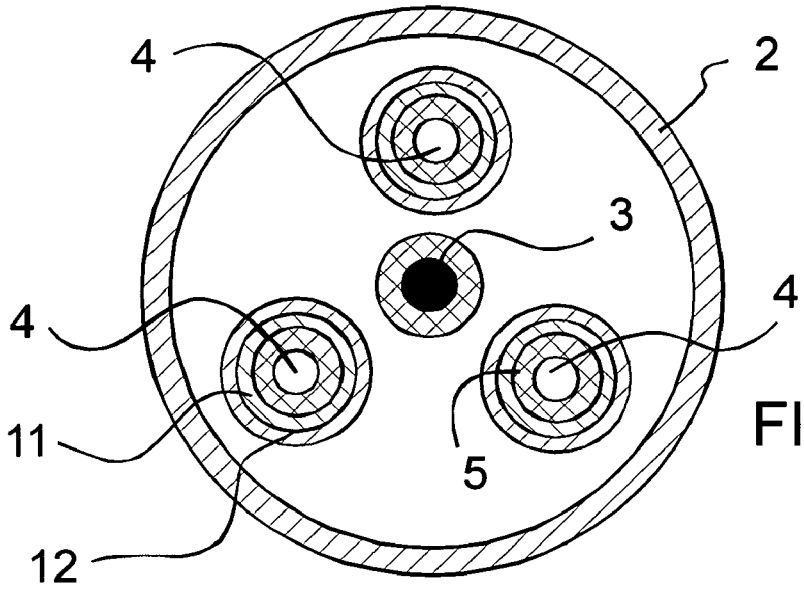
FIG. 5 is a top view in cross section of a dielectric barrier discharge lamp with a cylindrical discharge vessel enclosing four electrodes.
Figure 6:
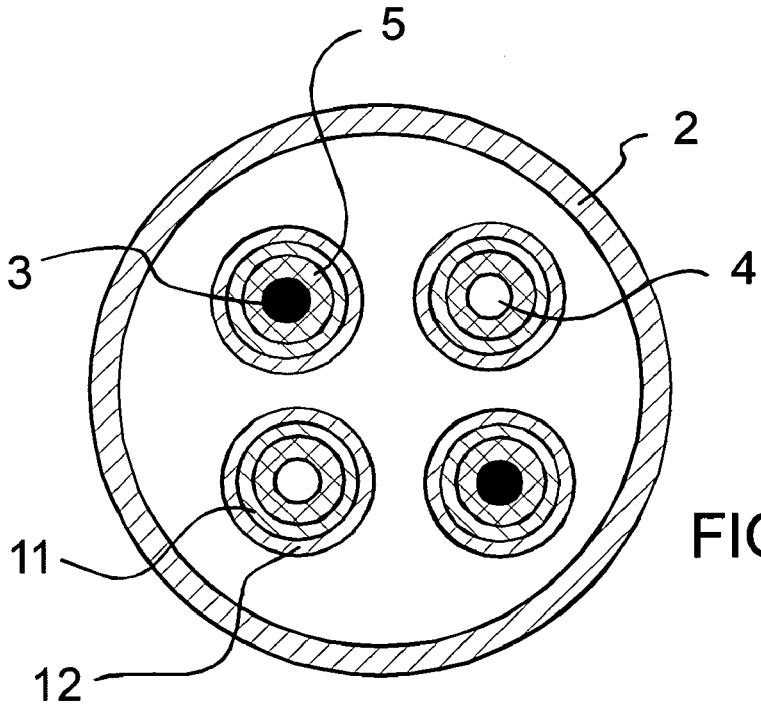
FIG. 6 is a top view in cross section of a dielectric barrier discharge lamp with a cylindrical discharge vessel enclosing four electrodes in an arrangement different from that shown in FIG. 5.

In FIGS. 5 and 6, a DBD lamp is shown with four electrodes of different type. In the embodiment shown in FIG. 5 there is one electrode 3 of the first type (anode/cathode) and there are three electrodes 4 of the second type (cathode/anode) around the electrode of the first type.

If the distances between the electrodes 4 of the second type and the electrode 3 of the first type are different, the discharge will take place between the electrodes of different type located next to each other. If the distances between the electrodes 4 of the second type and the electrode 3 of the first type are the same, the discharge will take place between the electrode 3 of the first type and the electrodes 4 of the second type accidentally thereby providing a more homogenous discharge distribution within the discharge vessel. In order to generate discharges between all electrodes 3 and 4, it is also important that the parameters (thickness, length, dielectric isolation) of the electrodes are identical.

In this arrangement, the four electrodes build a group with only one active pair of electrodes at a time to generate a discharge. In this embodiment, all of the electrodes 3 and 4 are covered by a dielectric insulating layer 5 and the electrodes 4 of the second type are further provided with a reflecting layer 11 covering at least a part of the dielectric layer 5 inside the discharge vessel and a luminescent layer 12 covering at least a part of the reflecting layer 11 as already discussed in detail above. In the embodiment shown in FIG. 6, there are two electrodes of the first type (anode/cathode) and two electrodes of the second type (cathode/anode) inside the discharge vessel 2. In this arrangement, two electrodes of different type build a group (pair) of electrodes with only one electrode assigned to one of the two types, therefore it is possible to establish two discharge paths at the same time, i.e. in each excitation interval. Due to the fact that two discharge paths are generated at the same time, the luminosity of the arrangement is doubled with respect to the embodiment shown in FIG. 5 with the same number of electrodes. If the distance between the electrodes of a pair is smaller than the distance between the pairs, two constant discharge paths will be formed. If however the four electrodes are arranged on the corner points of a square, as shown in FIG. 6, e.g. the distances between the electrodes of a pair and between the pairs is the same, random discharge paths will be formed resulting in a more homogenous gas excitation. In this embodiment, all of the electrodes 3 and 4 are covered by a dielectric insulating layer 5 and the electrodes of both type are further provided with a reflecting layer 11 covering at least a part of the dielectric layer 5 inside the discharge vessel and a luminescent layer 12 covering at least a part of the reflecting layer 11 as already discussed in detail above.

An even better luminosity of the DBD lamp can be accomplished if an electrode array of several groups of electrodes is used inside the discharge vessel. In such an array of several groups of electrodes in a discharge vessel, the number of concurrent discharge paths is equal to the number of groups in the array. Each group consists of one electrode of the first type (anode/cathode) and at least one electrode of the second type (cathode/anode). If the distance of electrodes in a group of electrodes is different, the discharge will take place between the electrodes of different type located next to each other. If the distances between the electrodes of the different types are the same, the discharge will take place between the electrode of the first type and the electrodes of the second type accidentally thereby providing a more homogenous discharge distribution within the discharge vessel. In order to generate discharges between each electrode, it is also important that the parameters (thickness, length, dielectric isolation) of the electrodes are identical.

Figure 7:
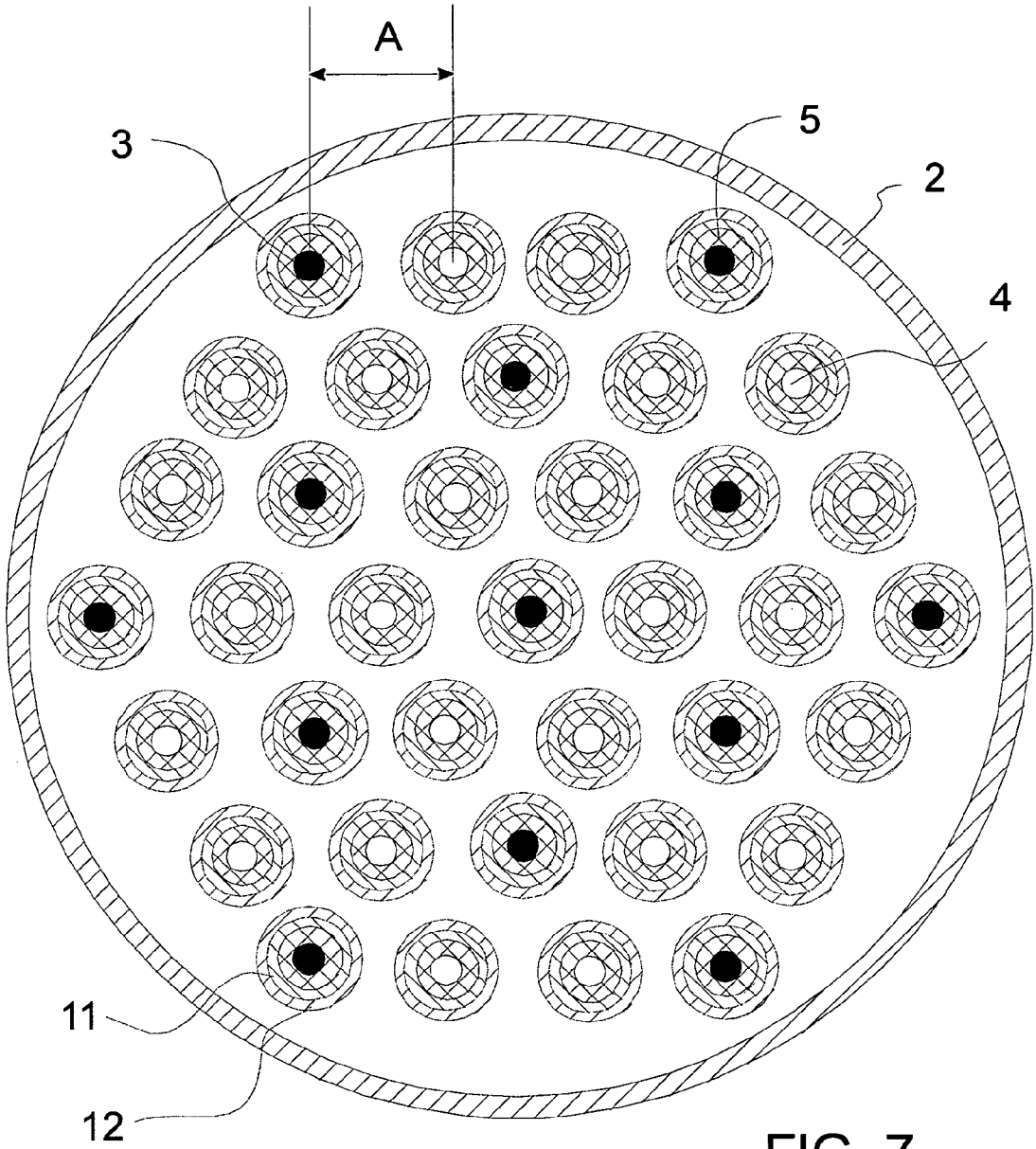
FIG. 7 is a top view in cross section of a dielectric barrier discharge lamp with a cylindrical discharge vessel enclosing an array of multiple electrodes.
Figure 8:
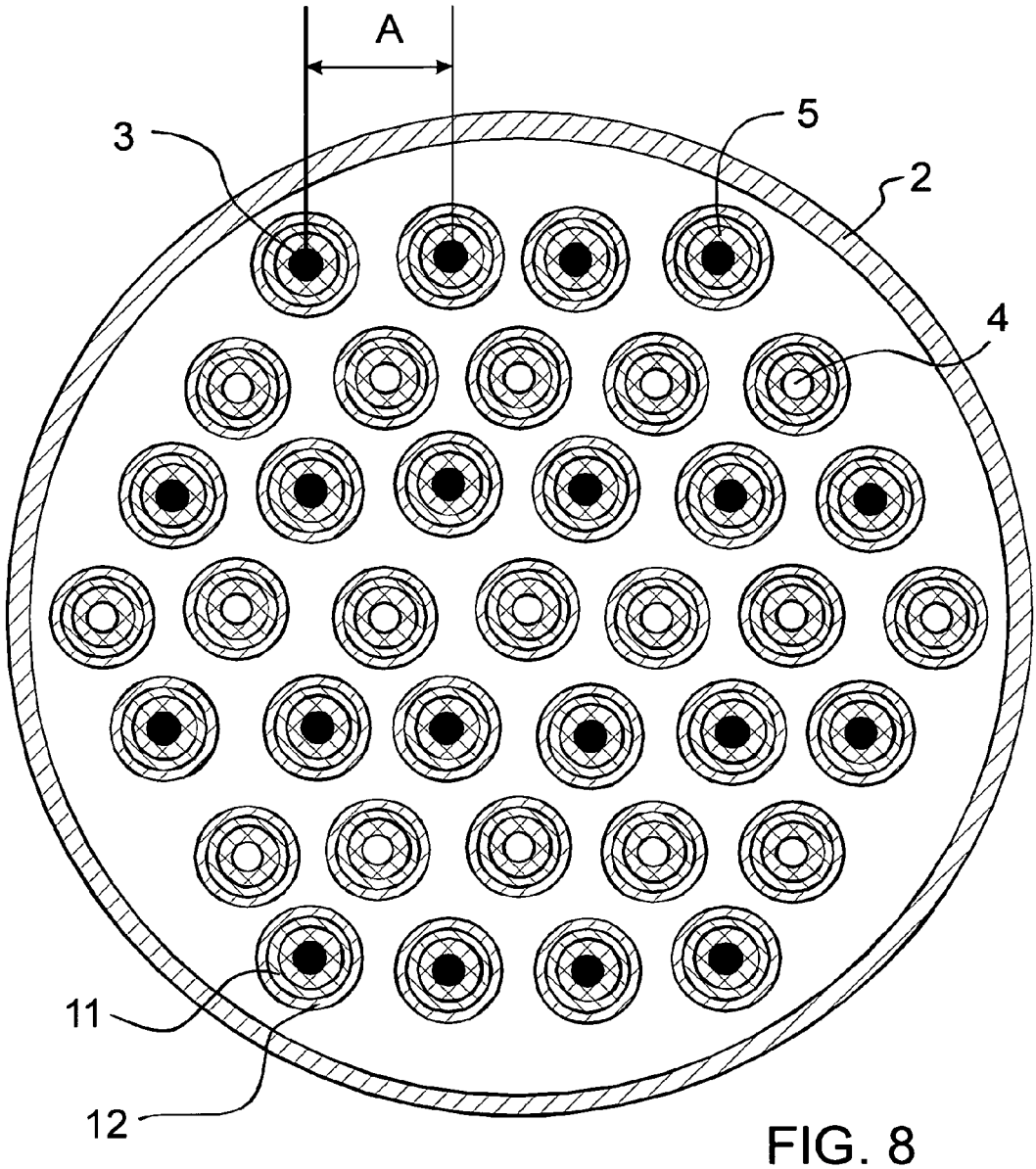
FIG. 8 is a top view in cross section of a dielectric barrier discharge lamp with a cylindrical discharge vessel enclosing a further array of multiple electrodes.

In the preferred embodiments shown in FIGS. 7 and 8, the electrodes are arranged in a hexagonal lattice (resembling a honeycomb pattern). The hexagonal arrangement is preferable because a hexagonal lattice has a relatively high packing density, as compared with other periodic lattices, e.g. a square lattice. This means that the useful volume of the discharge vessel 2 is filled most efficiently in this manner, at least when it is desired to maximize the $(\Sigma_i(V_i))/Ve$ ratio, where $V_i$ is the volume of the i-th electrode, and Ve is the volume of the discharge vessel 2.

The number of electrodes 3 and 4 within a discharge vessel 2 may vary according to size or desired power output of the lamp 1. For example, seven, nineteen or thirty-seven electrodes may form a hexagonal block.

Figure 9:
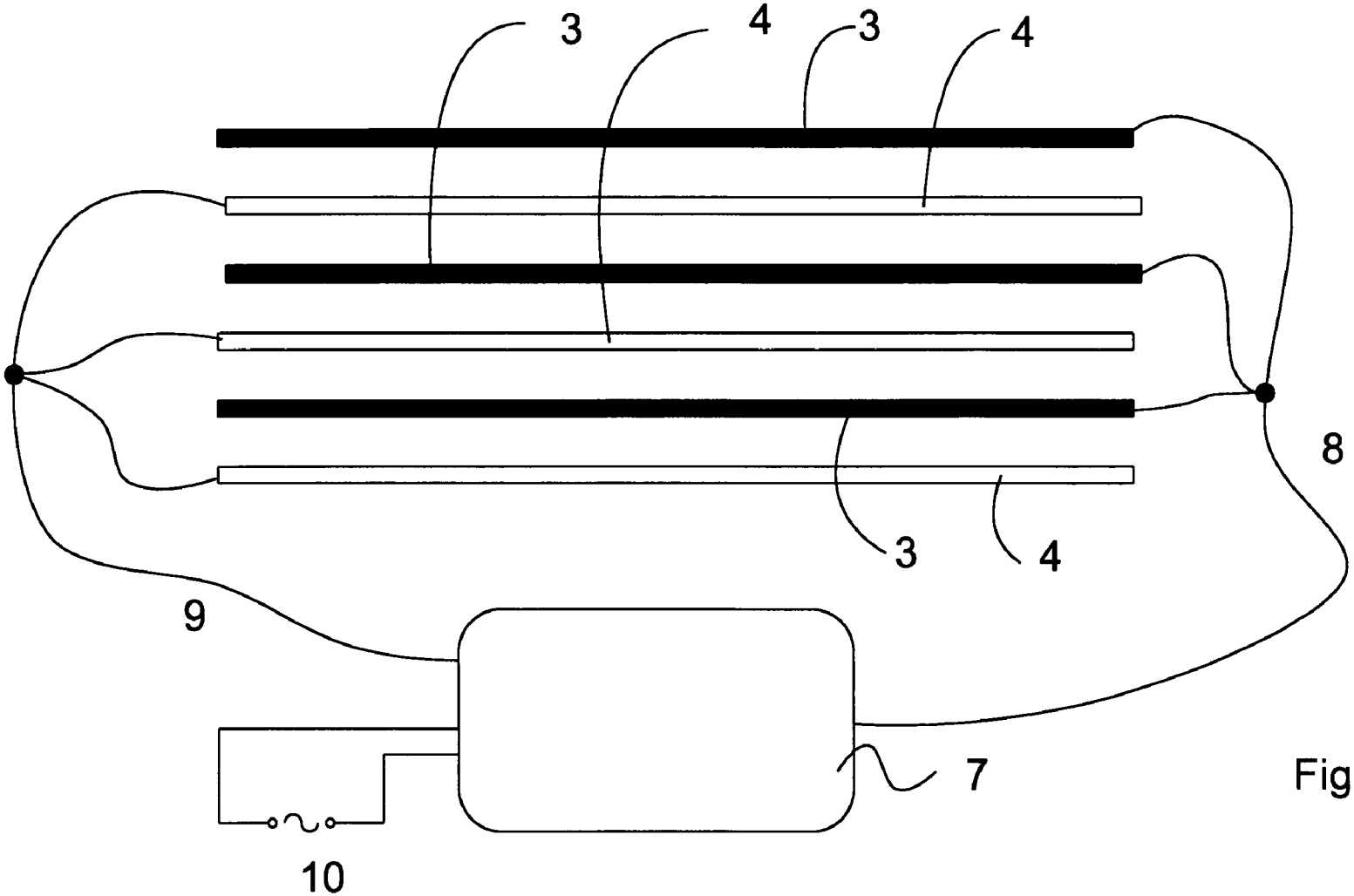
FIG. 9 is a schematic side view of the electrode arrangement, in which the electrodes of the same type are interconnected with each other and connected to an AC power supply.

The dielectric barrier discharge (also termed as dielectrically impeded discharge) is generated by a first set of interconnected electrodes 3 and a second set of interconnected electrodes 4. The term "interconnected" indicates that the electrodes 3 and 4 are on a common electric potential, i.e. they are connected to each other within a set, as shown in FIG. 9. The electrodes 3 of the first type are connected to each other end with one terminal of an AC power supply 7 via conductor 8 and the electrodes 4 of the second type are connected with each other end with the other terminal of an AC power supply 7 via conductor 9. The AC power supply 7 is connected to the mains voltage 10. In order to ensure better overview of the two electrode sets, in the drawings electrodes 4 of the second type (cathodes/anodes) are white while electrodes of the first type (anodes/cathodes) 3 are black.

In the embodiment shown in FIG. 7, the distance between two neighboring electrodes of different type is approx. 3-5 mm. This distance is also termed as the discharge gap, and its value also influences the general parameters of the discharge process within the discharge vessel 2.

As shown in FIGS. 7 and 8, the electrodes 3 and 4 of both the first and second type are placed in the lattice points of the hexagonal lattice. In the embodiment shown in FIG. 7, one electrode of the first type is surrounded by six (three in the corner points) electrodes of the second type of electrodes. In this arrangement the number of electrodes of the different types is different. The hexagonal lattice is formed of 13 electrodes of the first type and 24 electrodes of the second type, altogether 37 electrodes. It means that during excitation 13 concurrent and independent discharge paths can be formed between the electrodes providing a good luminosity and a high output of light intensity.

In the embodiment shown in FIG. 8, there are only electrodes of the same type in one row with alternating type of electrodes in the neighboring rows. In this arrangement the number of electrodes of the different types is similar. The hexagonal lattice is formed of 20 electrodes of the first type and 17 electrodes of the second type, altogether 37 electrodes. It means that during excitation 17 concurrent and independent discharge paths can be formed between the electrodes providing an even better luminosity and a higher output of light intensity.

In the embodiments shown in FIGS. 7 and 8, all of the electrodes 3 and 4 are covered by a dielectric insulating layer 5 and the electrodes of both type are further provided with a reflecting layer 11 covering at least a part of the dielectric layer 5 inside the discharge vessel and a luminescent layer 12 covering at least a part of the reflecting layer 11 as already discussed in detail above. In these embodiments because of the relatively large number of electrodes, the overall surface emitting visible light is much larger than that of conventional DBD lamp configurations.

In addition to the electrodes 3 and 4, also the internal or external surface 15 of the discharge vessels 2 or both the internal and external surface of the discharge vessels 2 may be covered with a layer of luminescent material (not shown). As a luminescent material many compounds and mixtures containing phosphor may be used for which examples are given above. If an additional envelope is provided around the discharge vessel, the luminescent layer may also cover the internal surface of the envelope. In any case, the envelope is preferably not transparent but only translucent. In this manner, the relatively thin electrodes 3 and 4 within the discharge vessel 2 are barely perceptible, and the lamp 1 also provides a more uniform illuminating external surface. It is also possible to cover the external surface of the discharge vessel or envelope with a luminescent layer, though in this case the discharge vessel 2 must be substantially non-absorbing in the UV range, otherwise the lamp will have a low efficiency.

In all embodiments shown, it is preferred that the wall thickness of the dielectric layer 5 should be substantially constant, mostly from a manufacturing point of view, and also to ensure an even discharge within the discharge vessel 2 along the full length of the electrodes. The thickness of the dielectric layer should be kept as low as possible and may be approximately 0.25 mm.

Finally, it must be noted that the parameters of the electric field and the efficiency of the dielectric barrier discharge within the discharge volume also depend on a number of other factors, such as the excitation frequency, exciting signal shape, gas pressure and composition, etc. These factors are well known in the art, and do not form part of the present invention. Instead of selecting a mixture of phosphor compounds for producing a generally white emission, VUV to UV converting phosphors may also be applied to the electrodes. If such a phosphor is applied both to the electrodes and the lamp wall, we receive a mercury free UV source. If this UV emitting phosphor is applied only to the electrodes, but to the wall still a white emitting phosphor blend is applied, then the UV radiation coming from the electrodes can directly excite the phosphor on the lamp wall and a further efficiency gain can be achieved as UV of wavelength at or above 260 nm has much lower chance to be absorbed by the electrodes than VUV in the wavelength range of 140-180 nm.

The proposed electrode-discharge vessel arrangement provides for a substantial increase of the efficiency of DBD lamps with internal multi electrode configuration. This increase may be in the range of 20 to 60 percent also depending of the geometry of the electrode configuration and the lamp design. A relatively large number of electrodes may be used within the discharge vessel for providing a large number of micro-discharges at a time resulting in a homogenous distribution of the discharges and high luminosity of the DBD lamp. Due to the luminescent and reflective layer on the electrodes, the light emitting surface inside the discharge vessel can be enlarged which results in a higher luminous output of the lamp.

The invention is not limited to the shown and disclosed embodiments, but other elements, improvements and variations are also within the scope of the invention. For example, it is clear for those skilled in the art that a number of other forms of the discharge vessel 2 or envelope may be applicable for the purposes of the present invention, for example, the envelope may have a triangular, square hexagonal cross-section. Conversely, the electrodes may be arranged in various types of lattices, such as square (cubic) or even non-periodic lattices, though the preferred embodiments foresee the use of periodic lattices with substantially equally shaped, uniformly sized electrodes. Also, the material of the electrodes may vary. Even the material of the reflecting and luminescent layer may be selected from a large group of compounds.

The invention claimed is:

1. A dielectric barrier discharge lamp comprising a) a discharge vessel including a single wall and having a principal axis, the discharge vessel enclosing a discharge volume filled with a discharge gas, the discharge vessel further comprising end portions intersected by the principal axis;

b) at least two interconnected electrodes of a first type and at least two interconnected electrodes of a second type, the electrodes of one type being energized to act as a cathode and the electrodes of the other type being energized to act as an anode, the electrodes being substantially straight, elongated electrodes with a longitudinal axis substantially parallel to the principal axis of the discharge vessel;

c) at least one of the electrodes being positioned within the discharge volume;

d) the electrodes of at least one type being isolated from each other and from the other type by a separate dielectric layer;

e) at least one of the electrodes inside the discharge volume being provided with an outer luminescent layer; and f) at least one of the electrodes inside the discharge volume provided with a luminescent layer also comprising a reflective layer at least partially encapsulated by the luminescent layer.

2. A dielectric barrier discharge lamp comprising a) a discharge vessel having a wall formed about a principal axis, the discharge vessel enclosing a discharge volume filled with a discharge gas, the discharge vessel further comprising end portions intersected by the principal axis;

b) at least one electrode of a first type and at least one electrode of a second type, the electrodes of one type being energized to act as a cathode and the electrodes of the other type being energized to act as an anode, the electrodes being substantially straight, elongated electrodes with a longitudinal axis substantially parallel to the principal axis of the discharge vessel;

c) at least one of the electrodes being positioned within the discharge volume at a location spaced from the discharge vessel wall and offset from the principal axis of the discharge vessel;

d) the electrodes of at least one type being isolated by a separate dielectric layer, the entire dielectric layer being spaced from the wall of the discharge vessel; and e) at least one of the electrodes inside the discharge volume being provided with an outer luminescent layer.

* * * * *